US008807694B2

(12) United States Patent
Beng Keong et al.

(10) Patent No.: US 8,807,694 B2
(45) Date of Patent: Aug. 19, 2014

(54) WICKING ACCUMULATED INK AWAY FROM OPTICAL SENSOR IN INKJET PRINTER

(71) Applicants: Ang Beng Keong, Singapore (SG); Tay Swee Hwai, Singapore (SG); Mum Pew Ng, Singapore (SG); Chee Meng Chen, Singapore (SG)

(72) Inventors: Ang Beng Keong, Singapore (SG); Tay Swee Hwai, Singapore (SG); Mum Pew Ng, Singapore (SG); Chee Meng Chen, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 8 days.

(21) Appl. No.: 13/669,487

(22) Filed: Nov. 6, 2012

(65) Prior Publication Data

US 2014/0125726 A1 May 8, 2014

(51) Int. Cl.

| | |
|---|---|
| ***B41J 29/393*** | (2006.01) |
| ***B41J 29/38*** | (2006.01) |
| ***B41J 2/205*** | (2006.01) |
| ***B41J 2/165*** | (2006.01) |

(52) U.S. Cl.
USPC ..... 347/19; 347/14; 347/15; 347/22; 347/29

(58) Field of Classification Search
USPC ..... 347/14, 15, 19, 6, 22, 29
See application file for complete search history.

(56) References Cited

U.S. PATENT DOCUMENTS

| | | | | |
|---|---|---|---|---|
| 7,120,272 | B2 | 10/2006 | Guiguizian | |
| 7,350,902 | B2 | 4/2008 | Dietl et al. | |
| 8,033,628 | B2 | 10/2011 | Shi et al. | |
| 8,282,183 | B2 | 10/2012 | Burke et al. | |
| 8,438,730 | B2 * | 5/2013 | Ciminelli | 29/890.1 |
| 2009/0213166 | A1 * | 8/2009 | Burke et al. | 347/19 |
| 2011/0205263 | A1 * | 8/2011 | Donahue et al. | 347/6 |

* cited by examiner

*Primary Examiner* — Sarah Al Hashimi
(74) *Attorney, Agent, or Firm* — Peyton C. Watkins

(57) ABSTRACT

An inkjet printer includes an inkjet printhead having a printhead die with an array of nozzles, and a media advance system for moving recording medium along a media path toward a print region. A carriage moves the inkjet printhead back and forth across the print region, and the carriage includes a holding receptacle for the inkjet printhead. The holding receptacle includes a bottom portion having an opening into which the printhead die extends. A viewing hole is disposed in the bottom portion of the holding receptacle for providing an optical pathway between an optical sensor and a portion of the media path. A wick is configured to contact the bottom portion of the holding receptacle proximate the viewing hole for removing accumulated ink.

13 Claims, 17 Drawing Sheets

WICKING ACCUMULATED INK AWAY FROM OPTICAL SENSOR IN INKJET PRINTER

CROSS REFERENCE TO RELATED APPLICATION

Reference is made to commonly assigned U.S. patent application Ser. No. 13/669,493 filed Nov. 6, 2012 by Tay Swee Hwai, Kat Huat Kuu and Han Tian Phua, entitled "Ink Barrier for Optical Sensor in Inkjet Printer."

FIELD OF THE INVENTION

The present invention generally relates to digital printing and more particularly to improving long term reliability of an apparatus used for detecting the type of print media being used in the printer.

BACKGROUND OF THE INVENTION

In a carriage printer, such as an inkjet carriage printer, a printhead is mounted in a carriage that is moved back and forth across a region of printing. To print an image on a sheet of paper or other print medium, the print medium is advanced a given nominal distance along a media advance direction and then stopped. Media advance is typically done by a roller and the nominal distance is typically monitored indirectly by a rotary encoder. While the print medium is stopped and supported on a platen, the printhead carriage is moved in a direction that is substantially perpendicular to the media advance direction as marks are controllably made by marking elements on the print medium—for example by ejecting drops from an inkjet printhead. The position of the carriage and the printhead relative to the print medium is precisely monitored directly, typically using a linear encoder. After the carriage has printed a swath of the image while traversing the print medium, the print medium is advanced; the carriage direction of motion is reversed; and the image is formed swath by swath.

In order to produce high quality images, it is helpful to provide information to printer controller electronics regarding the printing side of the recording medium, which can include whether it is a glossy or matte-finish paper. Such information can be used to select a print mode that will provide an optimal amount of ink in an optimal number of printing passes in order to provide a high quality image on the identified media type. It is well-known to provide identifying marks or indicia, such as a bar code, on a non-printing side of the recording medium to distinguish different types of recording media. It is also well known to use a sensor in the printer to scan the indicia and thereby identify the recording medium and provide that information to the printer control electronics. U.S. Pat. No. 7,120,272, for example includes a sensor that makes sequential spatial measurements of a moving media that contains repeated indicia to determine a repeat frequency and repeat distance of the indicia. The repeat distance is then compared against known values to determine the type of media present.

U.S. Pat. No. 8,033,628 discloses the use of a backside media sensor to read a manufacturer's code for identifying the media type. In this approach light from a light source is reflected from the backside of the media and received in a photosensor while the print media is being advanced past the photosensor. A source of unreliability in interpreting the signals is that media can slip during its advance past the photosensor.

Identification of media type by using transmitted light to detect a manufacturer's code, such as a bar code, has been disclosed in U.S. Pat. No. 8,282,183. In this approach, an optical sensor is provided on the carriage and a light source is provided on an opposite side of the media path so that the optical sensor on the carriage detects light transmitted through the print medium. This approach works well, and is especially useful in so-called L-path printers, where the print side of the print medium faces outward in the media input tray. However, it is found that if a viewing hole for the optical sensor is provided at the bottom of the carriage, accumulated ink at the bottom of the carriage can obstruct the viewing hole in some conditions after long-term usage of the printer.

Consequently, a need exists for a way to keep the optical path to a carriage-mounted sensor unobstructed by ink accumulation.

SUMMARY OF THE INVENTION

The present invention is directed to overcoming one or more of the problems set forth above. Briefly summarized, according to one aspect of the invention, the invention resides in an inkjet printer comprising: an inkjet printhead including a printhead die having an array of nozzles; a media advance system for moving recording medium along a media path toward a print region; a carriage for moving the inkjet printhead back and forth across the print region, wherein the carriage includes: a holding receptacle for the inkjet printhead, the holding receptacle including a bottom portion having an opening into which the printhead die extends; an optical sensor; and a viewing hole in the bottom portion of the holding receptacle, the viewing hole providing an optical pathway between the optical sensor and a portion of the media path; and a wick configured to contact the bottom portion of the holding receptacle proximate the viewing hole for removing accumulated ink.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
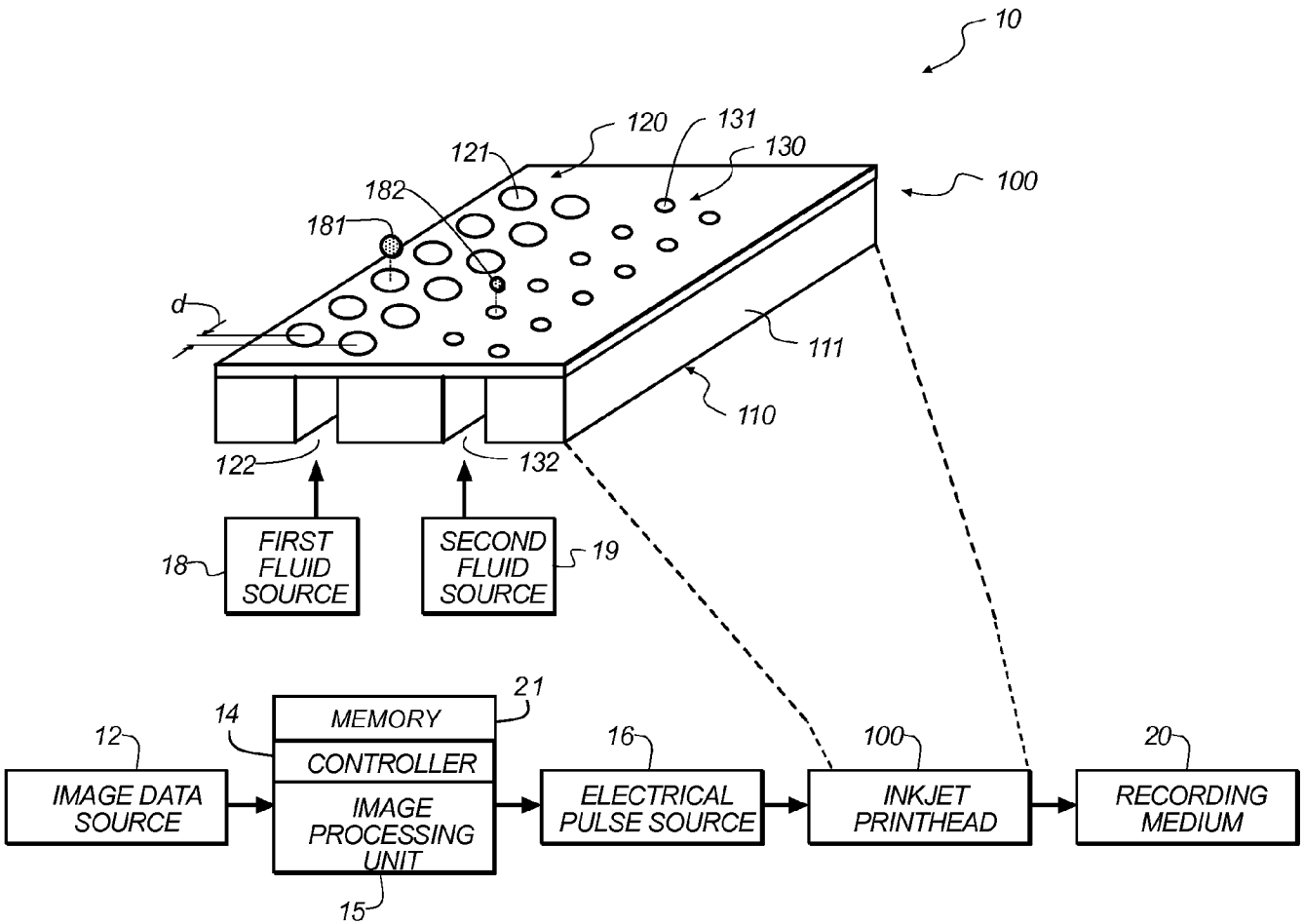
FIG. 1 is schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The inkjet printer system 10 includes an image data source 12, which provides data signals that are interpreted by a controller 14 as being commands to eject drops. The controller 14 includes an image processing unit 15 for rendering images for printing, and outputs signals to an electrical pulse source 16 of electrical energy pulses that are inputted to an inkjet printhead 100, which includes at least one inkjet printhead die 110. The controller 14 also includes identification processing for comparing an identified type of media to stored media types in memory 21, as will be discussed in detail hereinbelow.

In the example shown in FIG. 1, there are two nozzle arrays 120 and 130. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each nozzle array 120, 130 is 1200 per inch (i.e. d=1/1200 inch in FIG. 1). If pixels on a recording medium 20 were sequentially numbered along the paper advance direction, the nozzles 121 or 131 from one row of the nozzle array 120, 130 would print the odd numbered pixels, while the nozzles 121 or 131 from the other row of the nozzle array 120, 130 would print the even numbered pixels.

In fluid communication with each nozzle array 120 and 130 is a corresponding ink delivery pathway 122 and 132. The ink delivery pathway 122 is in fluid communication with the first nozzle array 120, and the ink delivery pathway 132 is in fluid communication with the second nozzle array 130. Portions of the ink delivery pathways 122 and 132 are shown in FIG. 1 as openings through a printhead die substrate 111. One or more inkjet printhead die 110 will be included in the inkjet printhead 100, but for greater clarity only one inkjet printhead die 110 is shown in FIG. 1. The inkjet printhead die 110 are arranged on a mounting support member as discussed below relative to FIG. 2. In FIG. 1, a first fluid source 18 supplies ink to the first nozzle array 120 via the ink delivery pathway 122, and a second fluid source 19 supplies ink to the second nozzle array 130 via the ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132, respectively. Also, in some embodiments, fewer than two or more than two nozzle arrays 120 and 130 can be included on the inkjet printhead die 110. In some embodiments, all nozzles 121 and 131 on inkjet printhead die 110 can be the same size, rather than having multiple sized nozzles on the inkjet printhead die 110.

The drop forming mechanisms associated with the nozzles 121 and 131 are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130 due to the larger nozzle opening area. Typically other aspects of the drop forming mechanisms (not shown) associated respectively with the nozzle arrays 120 and 130 are also sized differently in order to optimize the drop ejection process for the different sized drops. During operation, droplets of ink are deposited on the recording medium 20 (also sometimes called paper, print medium or medium herein).

Figure 2:
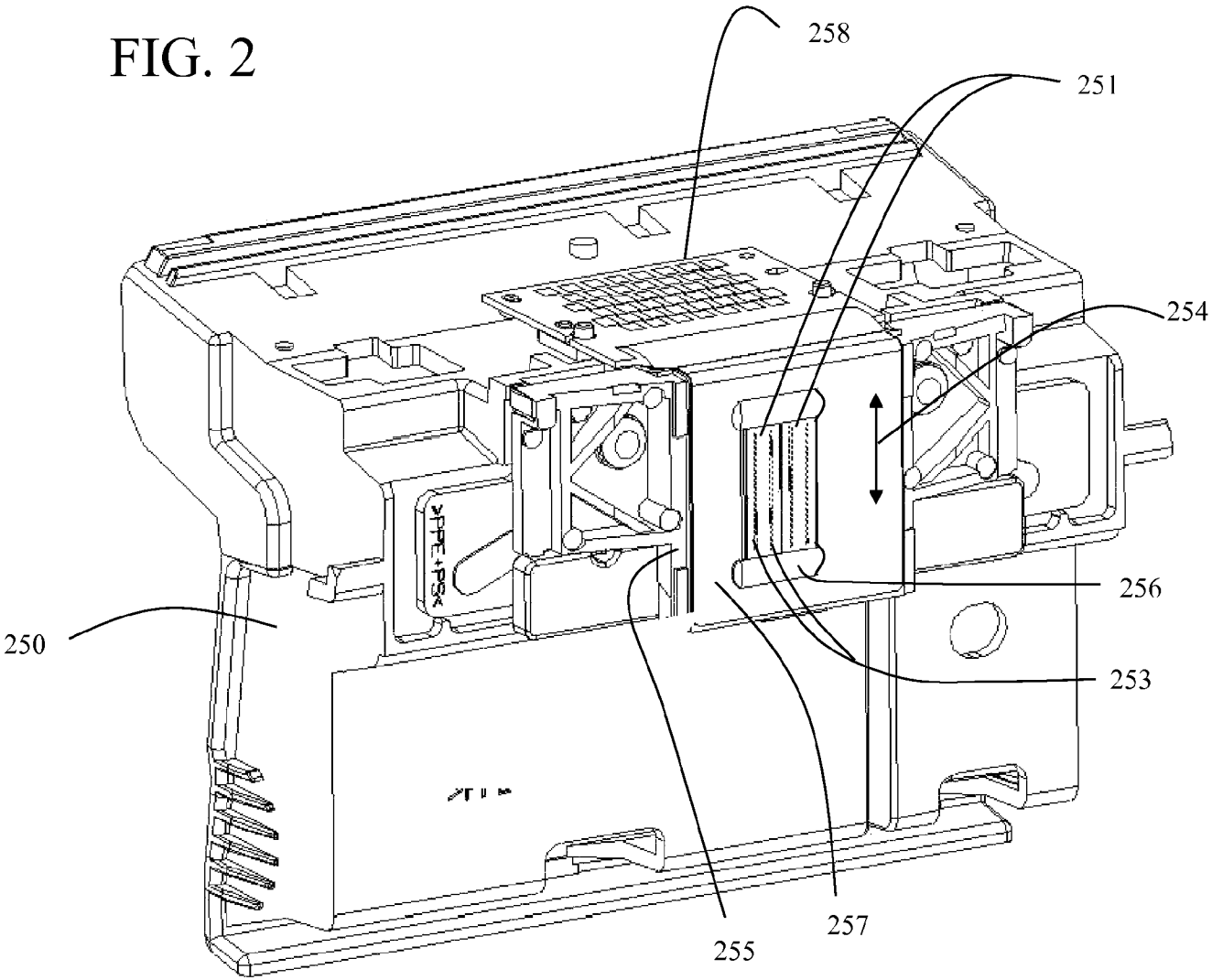
FIG. 2 is a perspective of a printhead.

FIG. 2 shows a perspective of a portion of a printhead 250, which is an example of the inkjet printhead 100. The printhead 250 includes two printhead die 251 (similar to inkjet printhead die 110 of FIG. 2) that are affixed to a common mounting support member 255. Each printhead die 251 contains two nozzle arrays 253, so that printhead 250 contains four nozzle arrays 253 altogether. The four nozzle arrays 253 in this example can each be connected to separate ink sources. Each of the four nozzle arrays 253 is disposed along a nozzle array direction 254, and the length of each nozzle array 253 along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving the printhead 250 across the recording medium 20. Following the printing of a swath, the recording medium 20 is advanced along a media advance direction 304 that is substantially parallel to the nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. The flex circuit 257 bends around a side of the printhead 250 and connects to a connector board 258. When the printhead 250 is mounted into a carriage 200 (see FIG. 5), the connector board 258 is electrically connected to a connector 244 on the carriage 200 so that electrical signals can be transmitted to the printhead die 251.

Figure 3:
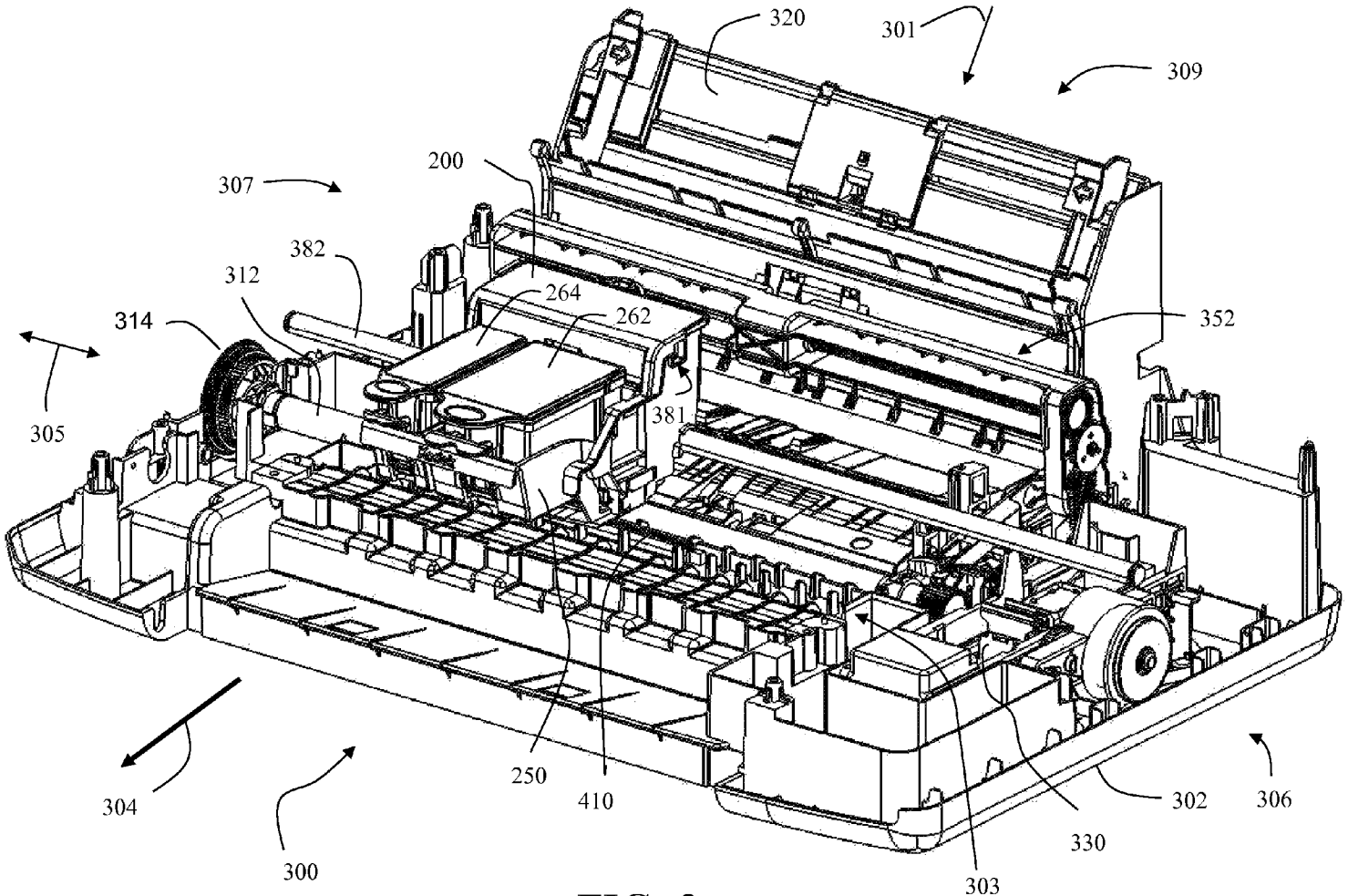
FIG. 3 is a perspective of an L-path carriage printer.
Figure 4:
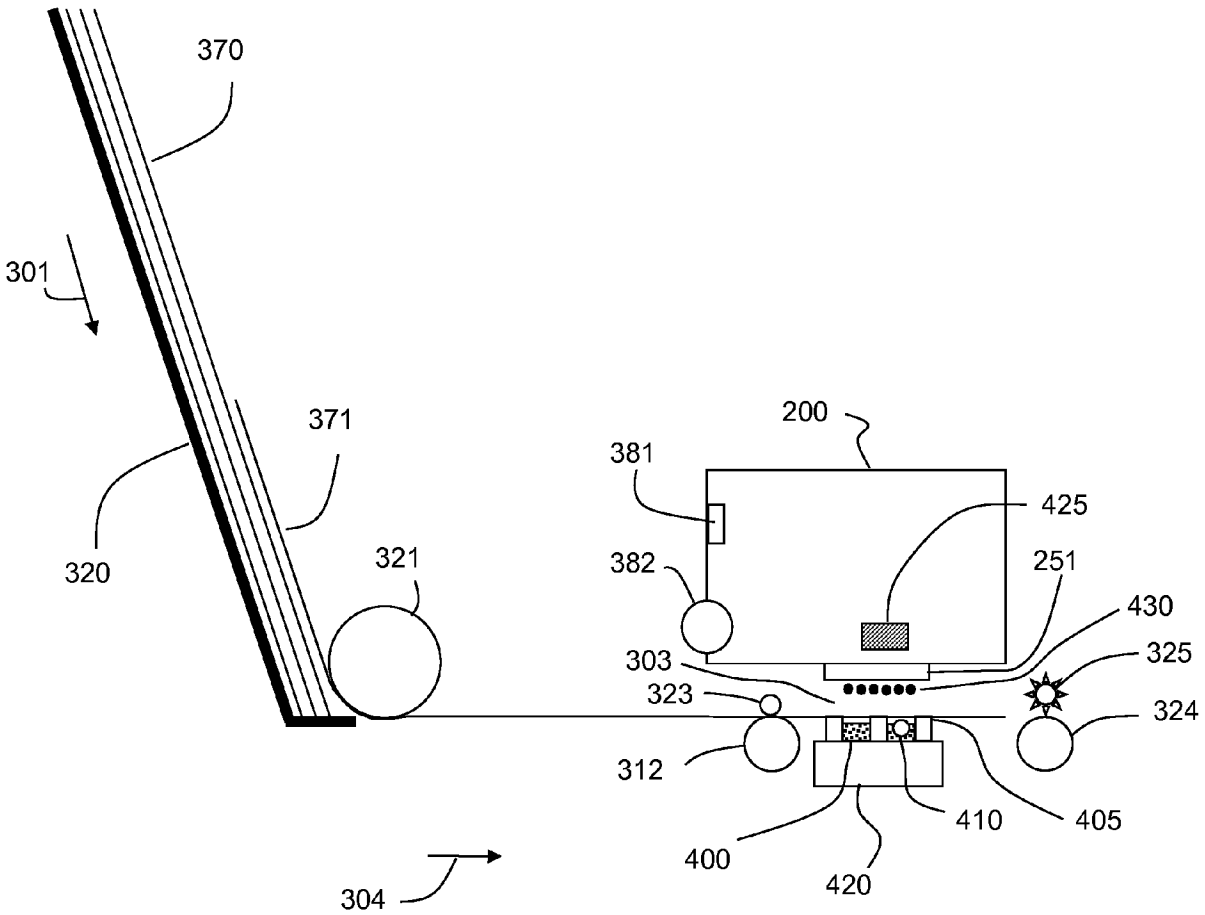
FIG. 4 is a block diagram illustrating the flow of the print media through the printing process of the L-shaped paper path.

FIG. 3 shows a perspective of portion of a desktop carriage printer and FIG. 4 shows a schematic side view. Some of the parts of the printer have been hidden in the view shown in FIG. 3 so that other parts can be more clearly seen. A printer chassis 300 includes a horizontal base 302. The carriage 200 is moved back and forth in carriage scan direction 305, between a right side 306 and a left side 307 of the printer chassis 300, while ink drops 430 are ejected from the printhead die 251 on the printhead 250 that is mounted on the carriage 200. The carriage 200 plus the printhead 250 and other components mounted on the carriage 200 is sometimes called a carriage assembly herein. A carriage motor (not shown) moves the carriage 200 along a carriage guide rail 382. An encoder sensor 381 is mounted on the carriage 200 and indicates location of the carriage 200 relative to a linear encoder (not shown). In other words, during times when the carriage 200 is moving in the carriage scan direction 305 and the recording medium 20 (see FIG. 1) is not moving, the relative position of the carriage 200 and the recording medium 20 is directly monitored. Likewise, the position of components affixed to the carriage 200 (including an optical sensor 425 described below) relative to the recording medium 20 are also directly monitored by use of the encoder sensor 381.

The printhead 250 is mounted in the carriage 200, and a multi-chamber ink supply 262 and a single-chamber ink supply 264 are mounted in the printhead 250. The mounting orientation of the printhead 250 is rotated relative to the view in FIG. 2 so that the printhead die 251 are located at the bottom side of printhead 250; the droplets of ink are ejected downward in the view of FIGS. 3 and 4. The multi-chamber ink supply 262, for example, contains three ink sources: e.g. cyan, magenta, and yellow ink; while the single-chamber ink supply 264 contains black ink. Toward the right side 306 of the printer chassis 300, in the example of FIG. 3, is a maintenance station 330.

In the L-shaped paper path shown in FIGS. 3 and 4, the recording medium 20 is loaded along a paper load entry direction 301 nearly vertically at an angle of sixty degrees or more relative to the horizontal base 302 against a media input support 320 at a rear 309 of the printer chassis 300. Several rollers are used to advance the recording medium 20 through the printer. A pick roller 321 on a pick arm assembly 352 is rotated to move a first piece or sheet 371 of a stack 370 of paper or other types of recording medium 20 in the media input support 320 from the paper load entry direction 301 to the media advance direction 304. The paper is then moved by a feed roller 312 and idler roller(s) 323 to advance toward the print region 303 (disposed along the carriage scan direction 305). The feed roller 312 is driven directly by a paper advance motor (not shown) that is connected by belt or gear engagement, for example at a drive gear 314. After the image is printed at the print region 303, the sheet 371 of the stack 370 is further advanced to a discharge roller 324 and star wheel(s) 325.

The print region 303 is defined as the region along the pathway of the carriage 200 as it moves the printhead 250 in its carriage scan direction 305. In many printers, particularly those that are configured to print borderless prints of photographic images, for example, a absorbent material 400 (FIG. 4) spans a predetermined length of the printer chassis 300. The absorbent material 400 functions as a collector for absorbing superfluous ink mist or oversprayed ink present in the print region 303. A media support, which can include support ribs or pins 405, protrudes through the absorbent material 400 for providing a surface on which the paper rests during printing and during scanning of the paper type. As defined herein, "media support" is defined as a support mechanism which functions primarily or entirely to support a print medium, such as paper and the like, during a stage of printing. The pins 405 are preferably disposed in a plurality of rows at predetermined locations relative to standard widths of print media, so that during borderless printing, ink that is oversprayed beyond the edges of the print medium lands primarily on the absorbent material 400, rather than on the pins 405.

Figure 5:
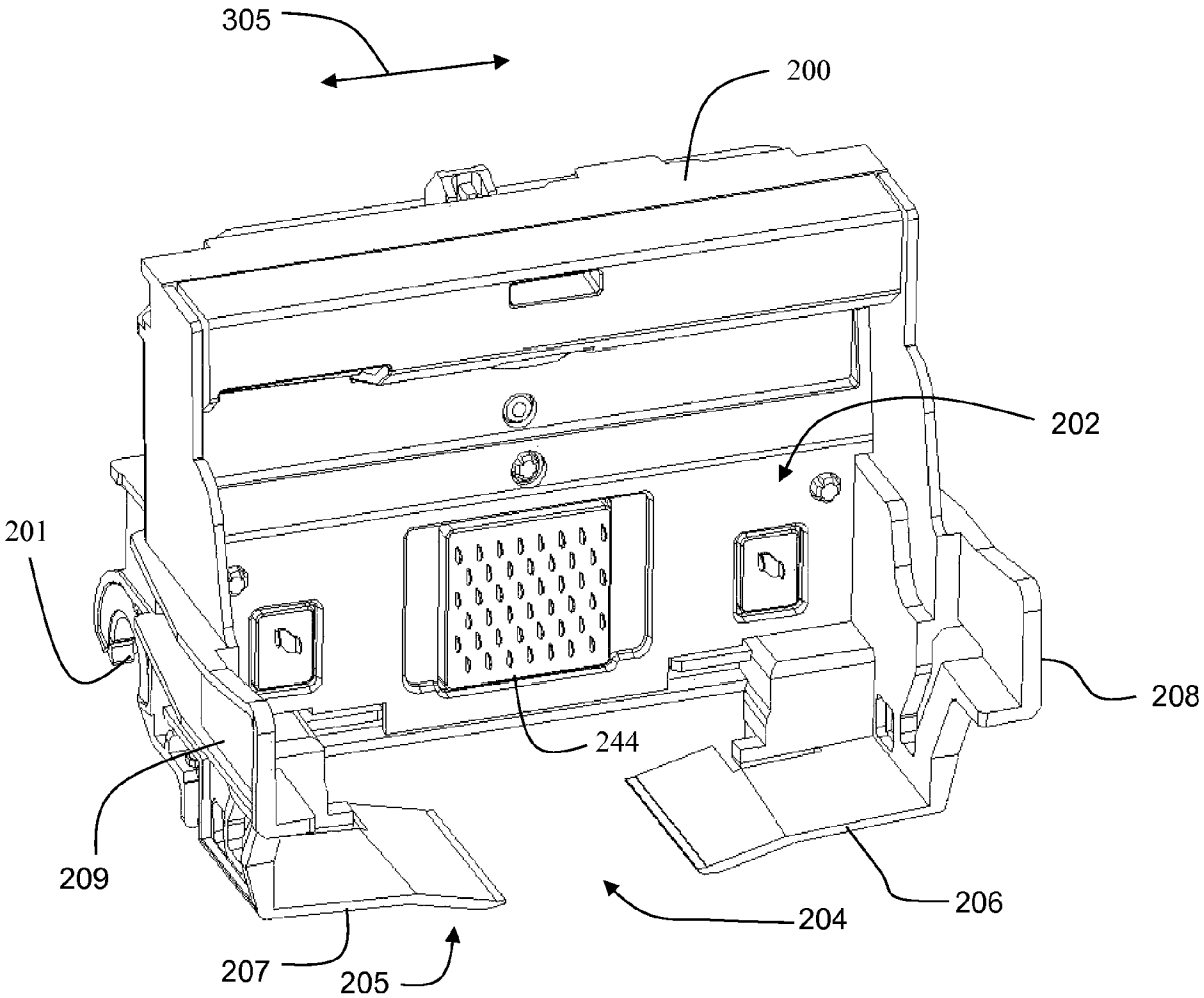
FIG. 5 is a perspective of a holding receptacle portion of a carriage of the printer.

FIG. 5 is a perspective of the carriage 200. The carriage 200 includes a holding receptacle 202 for an inkjet printhead 250 (see FIGS. 2, 6-7). The holding receptacle 202 includes a first side wall 208 and a second side wall 209 opposite the first side wall 208. The first side wall 208 and the second side wall 209 extend from a bottom portion 205 of the holding receptacle 202. The bottom portion 205 includes an opening 204 into which the printhead die 251 extend when the printhead 250 is mounted onto the carriage 200 (FIG. 8). In the example shown in FIG. 5, the bottom portion 205 includes a first flap 206 extending between the first side wall 208 and the opening 204, and a second flap 207 extending between the second side wall 209 and the opening 204. The carriage 200 includes one or more bushings 201 to glide along the carriage guide rode 382 (FIG. 3) in the carriage scan direction 305. The carriage 200 also includes a connector 244 to mate with the connector board 258 of the printhead 250 (FIG. 2).

Figure 6:
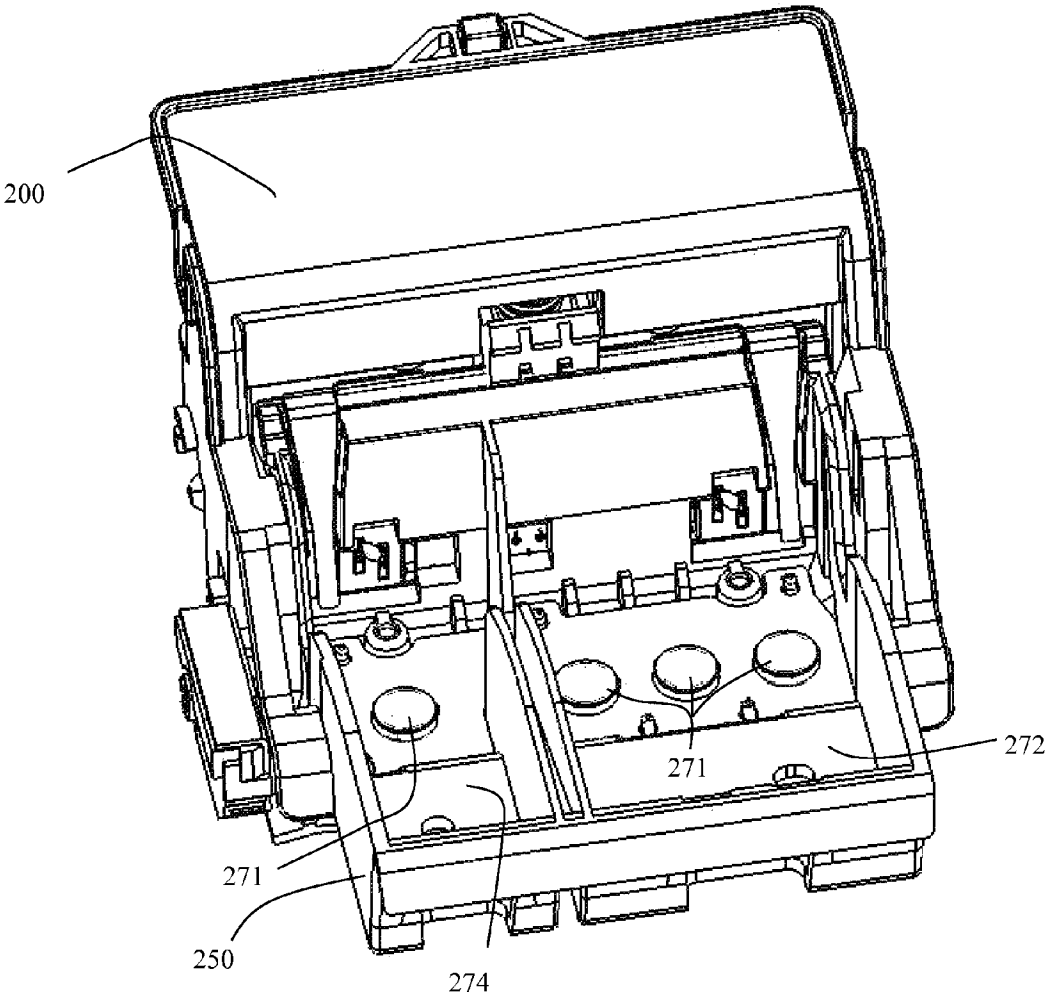
FIG. 6 is a perspective of a printhead mounted onto the carriage of FIG. 5.
Figure 7:
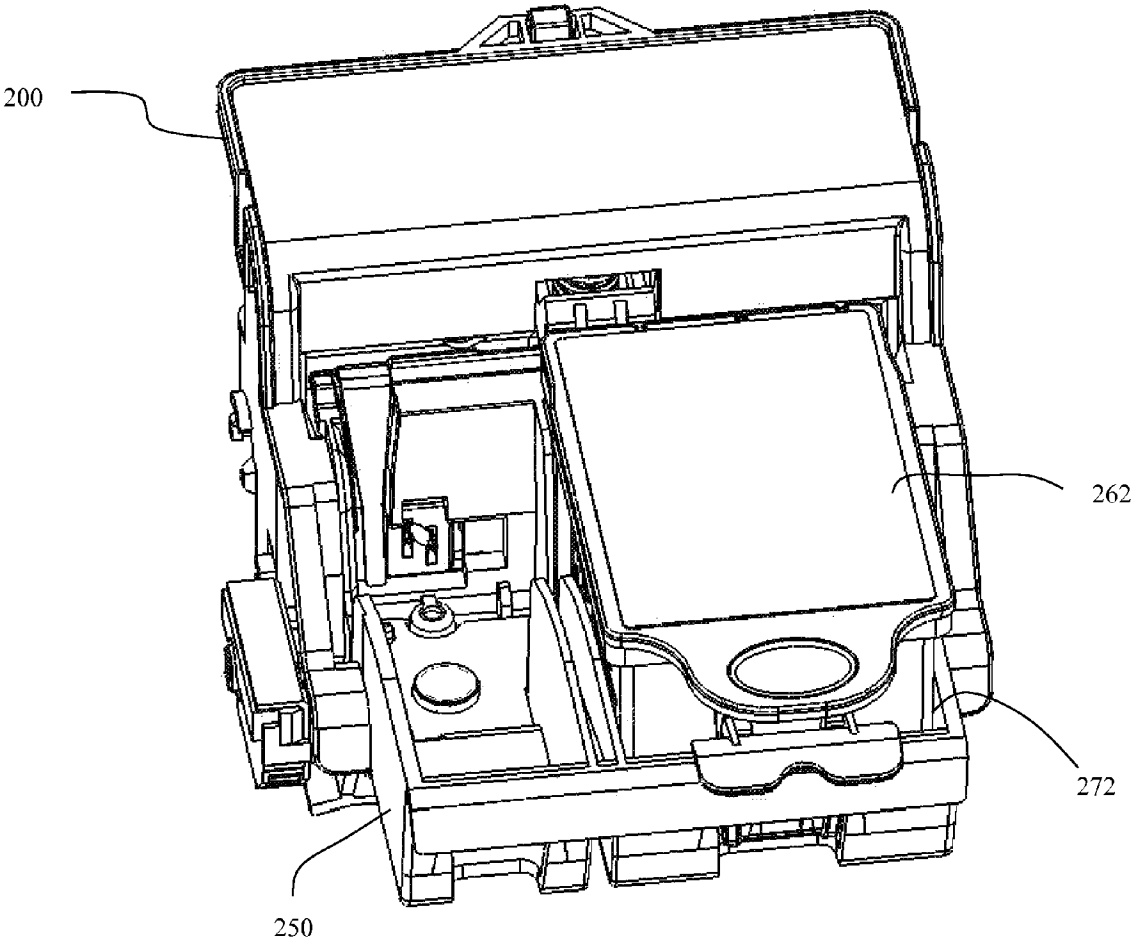
FIG. 7 is a perspective of an ink tank loaded into the printhead of FIG. 6.
Figure 8:
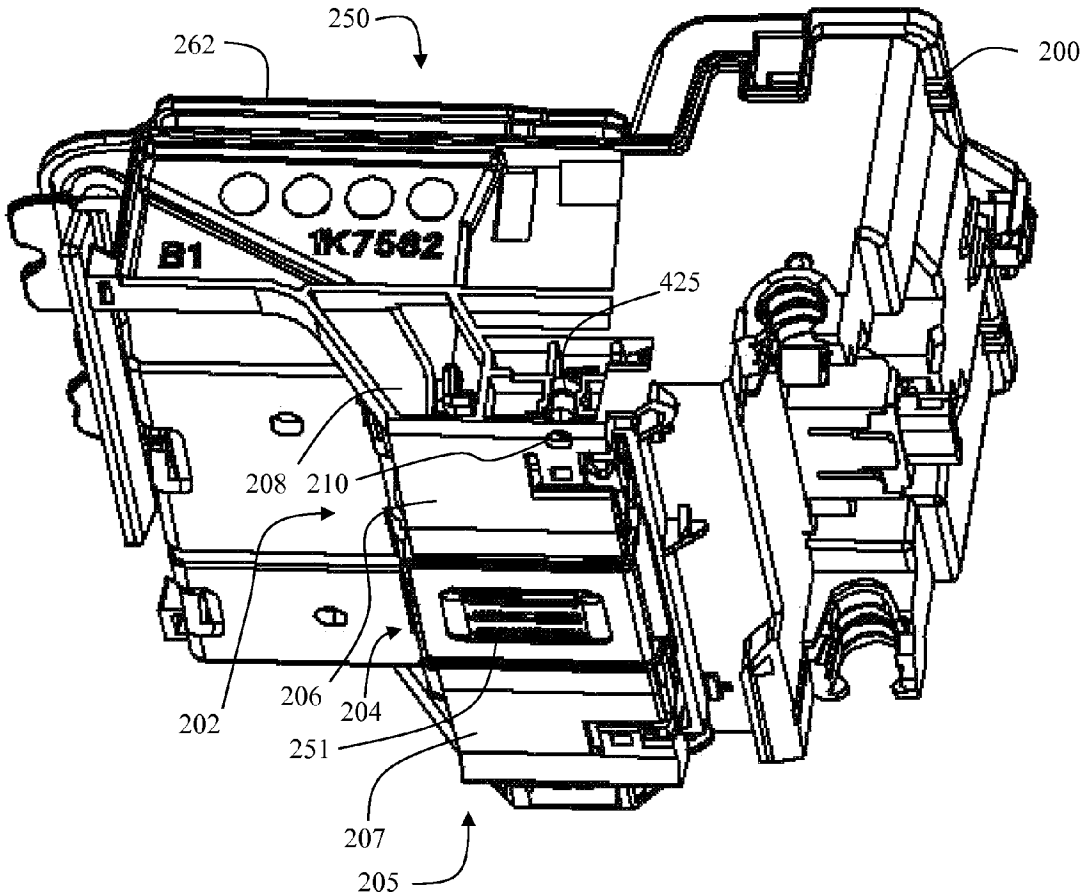
FIG. 8 is a bottom perspective of the carriage and printhead.

FIGS. 6 and 7 are perspectives of the printhead 250 mounted in the carriage 200. The printhead 250 includes a compartment 272 for the multi-chamber ink supply 262 (FIG. 3) and a compartment 274 for the single chamber ink supply 264. Ink ports 271 receive ink from the ink supplies 262 and 264 and provide the ink to the printhead die 251 of the printhead 250. FIG. 7 shows a perspective of the multi-chamber ink supply 262 loaded into the compartment 272 of the printhead 250.

Figure 9:
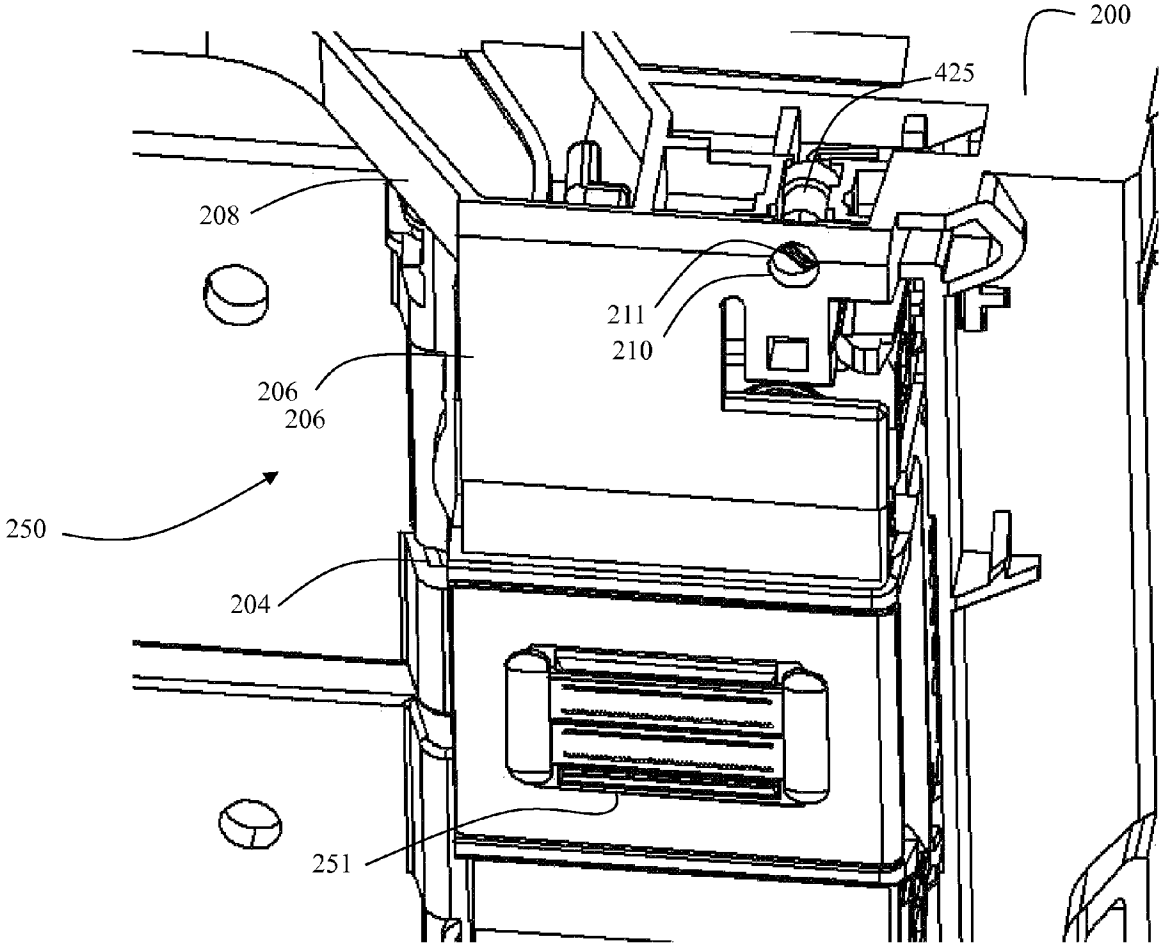
FIG. 9 is an enlarged view of a portion of FIG. 8.

FIG. 8 is a bottom perspective of the carriage 200 and the printhead 250 with the printhead die 251 extending into the opening 204, and FIG. 9 is an enlarged view of a portion of this region. The optical sensor 425 is mounted near the first side wall 208. A viewing hole 210 in the bottom portion 205 of the holding receptacle 202 provides an optical pathway for the optical sensor 425. In particular, the viewing hole 210 is disposed in the first flap 206. In the enlarged view of FIG. 9 it can be seen that the viewing hole 210 includes a narrow aperture slot 211 that blocks stray light from entering the optical sensor 425, thereby improving its signal to noise ratio.

Referring to FIG. 4, a platen 420 forms a foundation in which the absorbent material 400 is disposed. One or more light sources 410 are disposed proximate the absorbent material 400 for illuminating the sheet 371 as it passes below the carriage 200. When the sheet 371 is below the carriage 200, the light passes through the sheet 371, through the slot 211 and the viewing hole 210 (FIGS. 8-9) and into the optical sensor 425, which is attached to the carriage 200, for sensing the light transmitted through the sheet 371. In other words, the viewing hole 210 and the slot 211 provide an optical pathway between the optical sensor 425 and a portion of the media path. The one or more light sources 410 are disposed on a first side of the portion of the media path (below sheet 371 in FIG. 4) and the carriage 200 and the optical sensor 425 are disposed on a second side of the portion of the media path (above sheet 371 in FIG. 4) opposite the first side. A media identification code, such as a bar code or the like, is provided on the non-print side of the sheet 371 (the surface facing the light source 410) so that the sheet 371 can be identified via the transmitted light which is sensed by the optical sensor 425. During printing, the carriage 200 traverses back and forth across the print region 303 via the carriage guide rail 382 to position the printhead die 251 to eject ink drops 430 for printing onto the printing surface (surface facing the carriage 200) of the sheet 371 at precise locations determined by the image data and the position of the carriage 200 determined from the signals from encoder sensor 381 (see FIG. 3). During a prior step of media identification, the carriage 200 is guided by the carriage guide rail 382 to permit the optical sensor 425 to sense the transmitted light including the bar code pattern, while the relative position of the optical sensor 425 (being mounted on the carriage 200), is directly monitored by the encoder sensor 381, as described above relative to FIG. 3. In this manner, the printer is able to identify the particular type of media being used so that it can make any adjustments suitable for that particular media prior to printing.

Figure 10B:
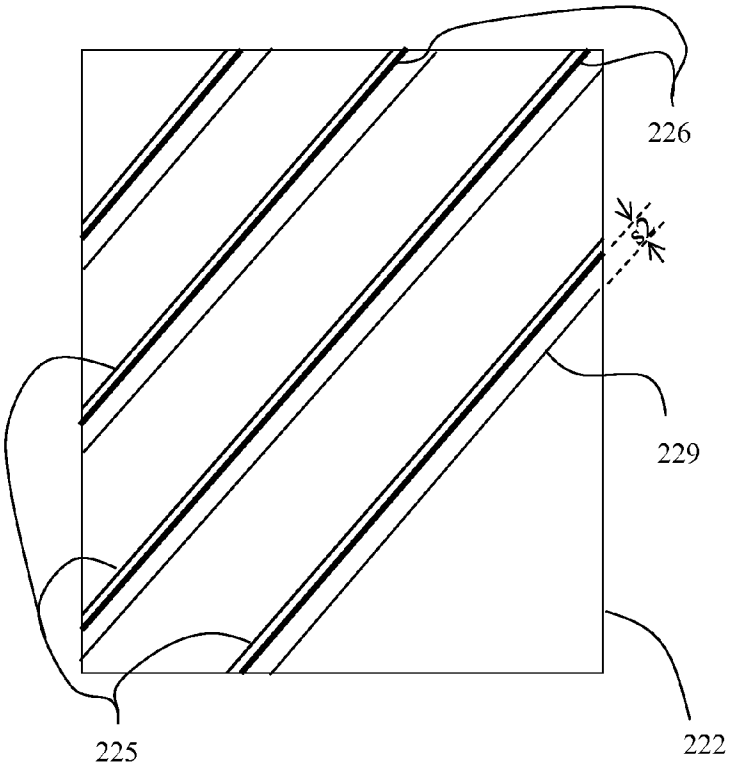
FIGS. 10A and 10B illustrate two different types of print media with correspondingly different bar codes.
Figure 10A:
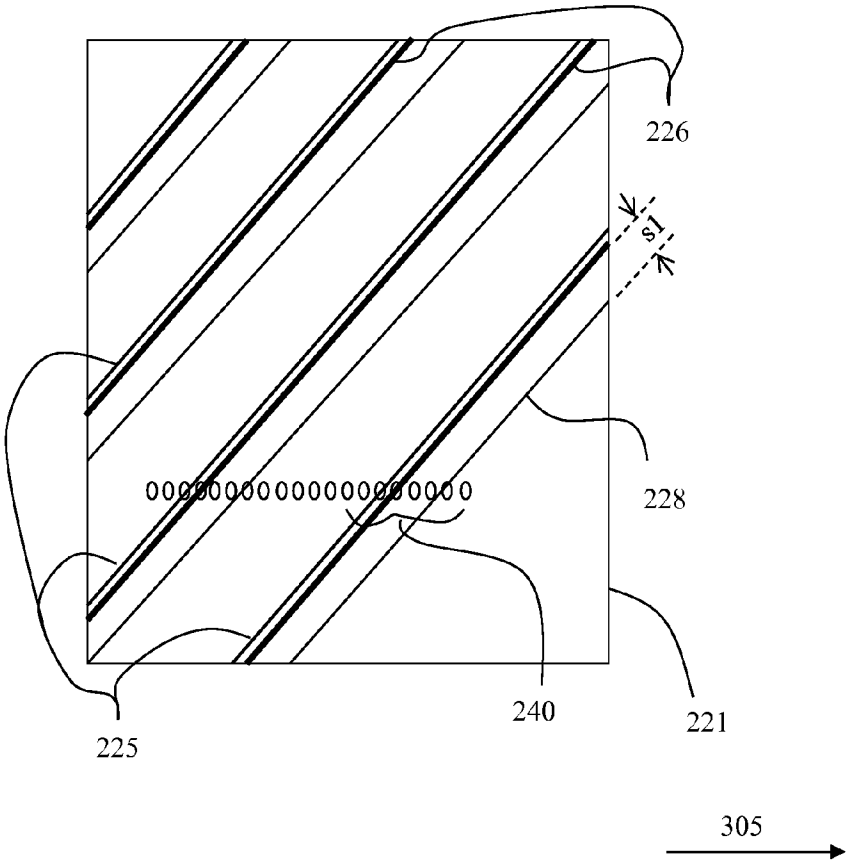

FIGS. 10A and 10B show schematic representation of markings on the backside of a first media type 221 of recording medium and a second media type 222 of recording medium respectively. In this embodiment, each of the various types of recording media has a reference marking consisting of a pair of "anchor bars" 225 and 226 which are located at a fixed distance with respect to one another for all media types. In addition, there is a first identification mark 228 on the first media type 221 in FIG. 10A, and there is a second identification mark 229 on the second media type 222 in FIG. 10B. In this example, the first identification mark 228 is spaced a distance s1 away from the anchor bar 226 on first media type 221, and the second identification mark 229 is spaced a distance s2 away from anchor bar 226 on the second media type 222, such that s1 does not equal s2. Thus in this example, it is the spacing of the identification mark from one of the anchor bars 225 and 226 that identifies the particular type of recording medium.

Ovals in FIG. 10A schematically represent successive fields of view 240 of the optical sensor 425 as the carriage 200 is scanned relative to the first media type 221 along the carriage scan direction 305. Because the field of view 240 of the optical sensor 425 moves along the carriage scan direction 305 as the carriage 200 moves, it is actually the projections of marking spacings s1 and s2 along the carriage scan direction 305 that are measured. Optical sensor data is sampled much more frequently than the fields of view 240 in FIG. 10A show, but only a few samples are shown for clarity. In addition, the actual field of view 240 can be a different size or shape than the ovals shown in FIG. 10A, as determined, for example by aperture shape (such as slot 211), the angle of the aperture plane relative to the plane of the recording medium, optical elements such as lenses, and optical path lengths.

The output signal of the optical sensor 425 can be amplified and filtered to reduce background noise and then digitized in an analog to digital converter. Once the amplified signal has been digitized, digital signal processing can be used to further enhance the signal relative to high frequency background noise. In addition, the time-varying signal can be converted into spatial distances to find peak widths or distances between peaks corresponding to the code pattern markings. Processed signal patterns are sent to a processor (for example a processor in the controller 14 of FIG. 1) and analyzed by comparing to signal patterns stored in memory 21 (see FIG. 1) to indicate media type.

In the examples shown in FIGS. 10A and 10B, the bar codes extend across the recording medium and are repeated a plurality of times on the recording medium. This configuration can be advantageous for the manufacturer of the recording medium in that recording media is typically manufactured in large rolls that are subsequently cut to size. If the bar code extends as in FIGS. 10A and 10B it can be applied while the recording medium is still in the large roll format, and cut to whatever size is required. Smaller bar codes that are positioned with respect to a particular edge or corner of the recording medium are not as easily provided.

A problem that can occur in the carriage configuration shown in FIGS. 8 and 9 is that after long-term usage of the printhead 250, ink can accumulate on the bottom portion 205 of the holding receptacle 202 and flow across the first flap 206 into the viewing hole 210 and obstruct the optical pathway between optical sensor 425 and sheet 371 (FIG. 4) of recording medium. If the viewing hole 210 includes a small aperture, such as narrow slot 211 (FIG. 9), a relatively small amount of accumulated ink can decrease the signal from the optical sensor 425, thereby impacting the reliability of media type detection.

Figure 11:
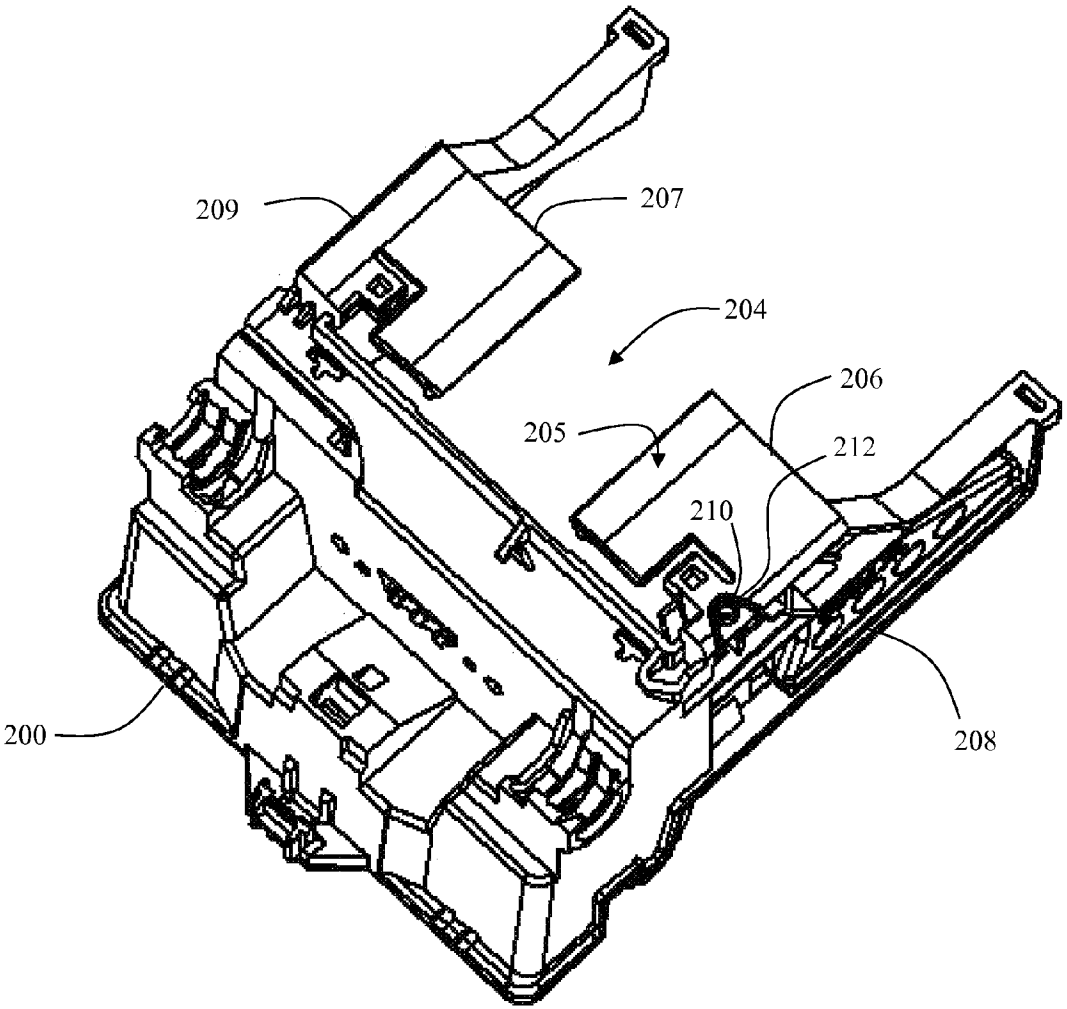
FIG. 11 is a bottom perspective of carriage including a barrier around a viewing hole, according to an embodiment of the invention.
Figure 12:
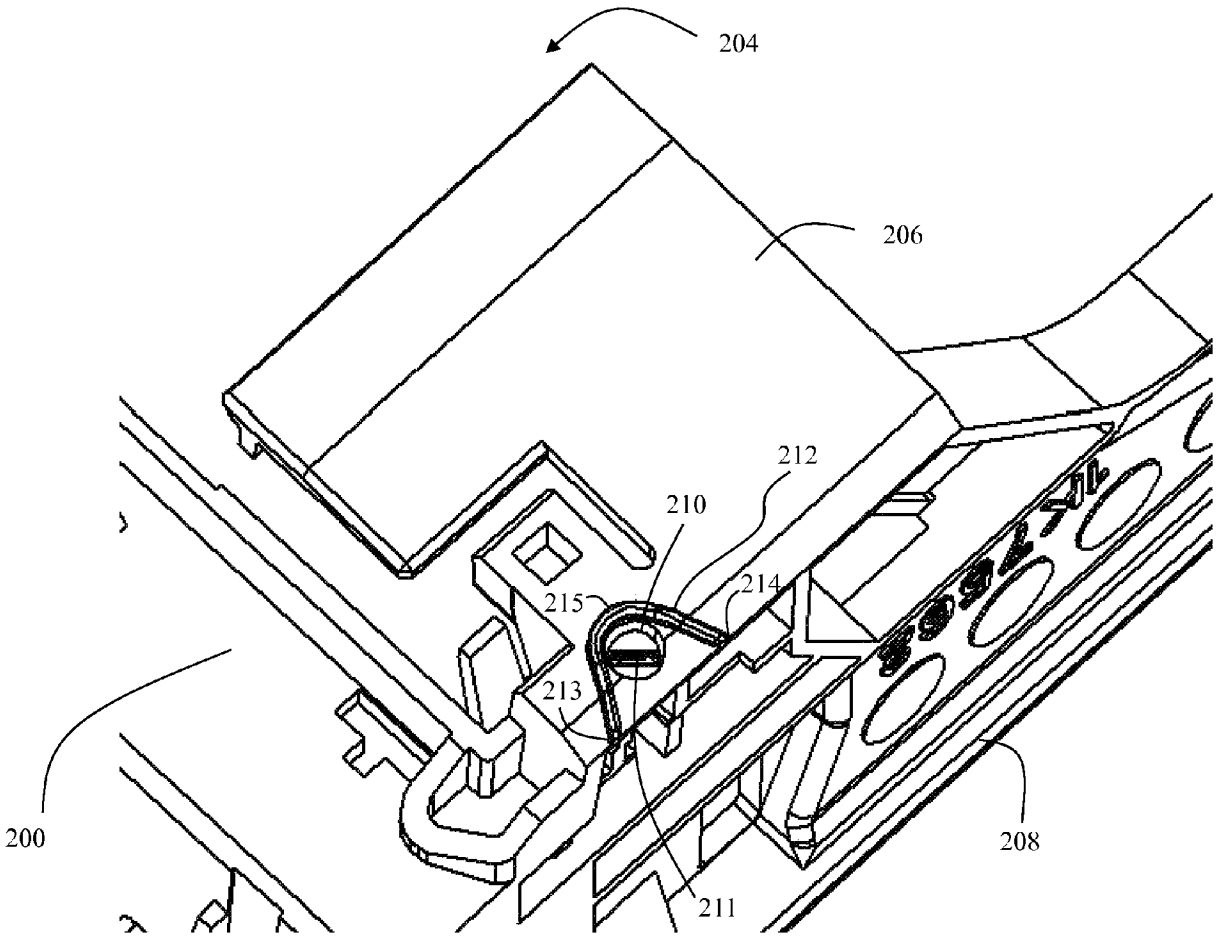
FIG. 12 is an enlarged view of a portion of FIG. 11.
Figure 13:
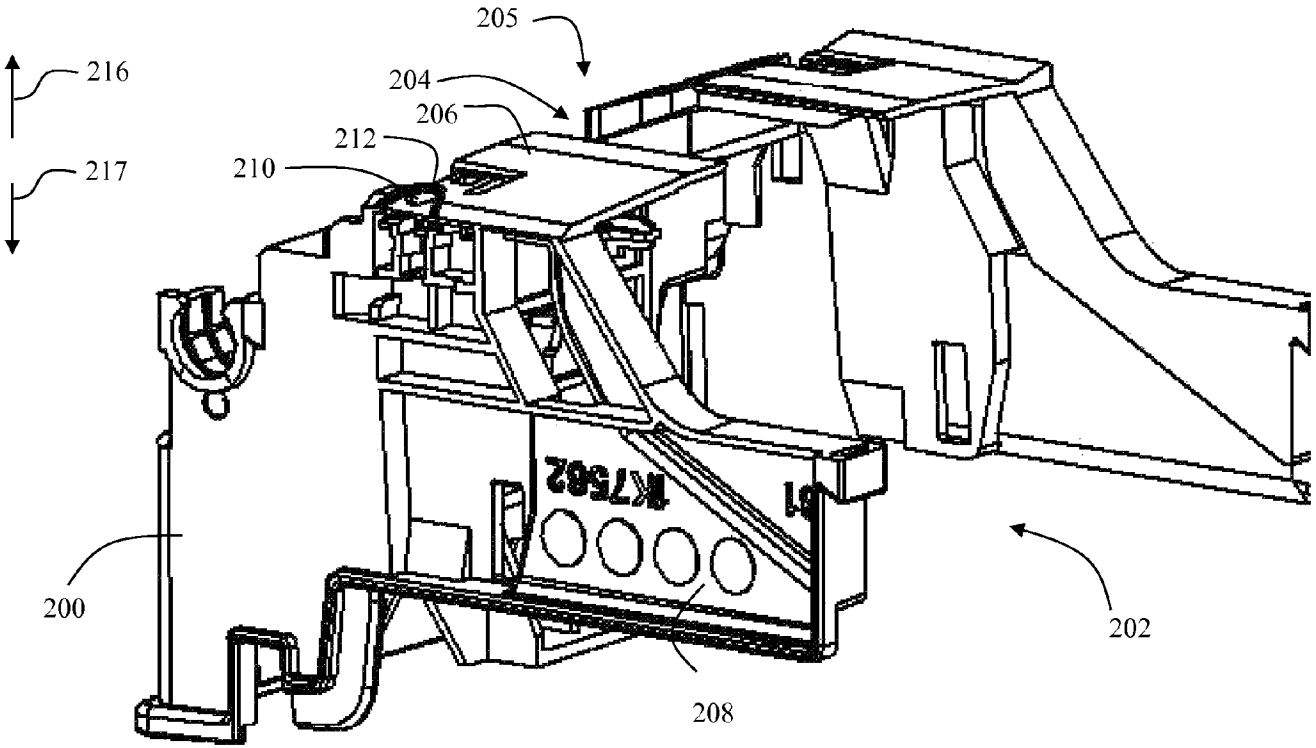
FIG. 13 is a side perspective of the carriage and barrier of FIG. 11.
Figure 14:
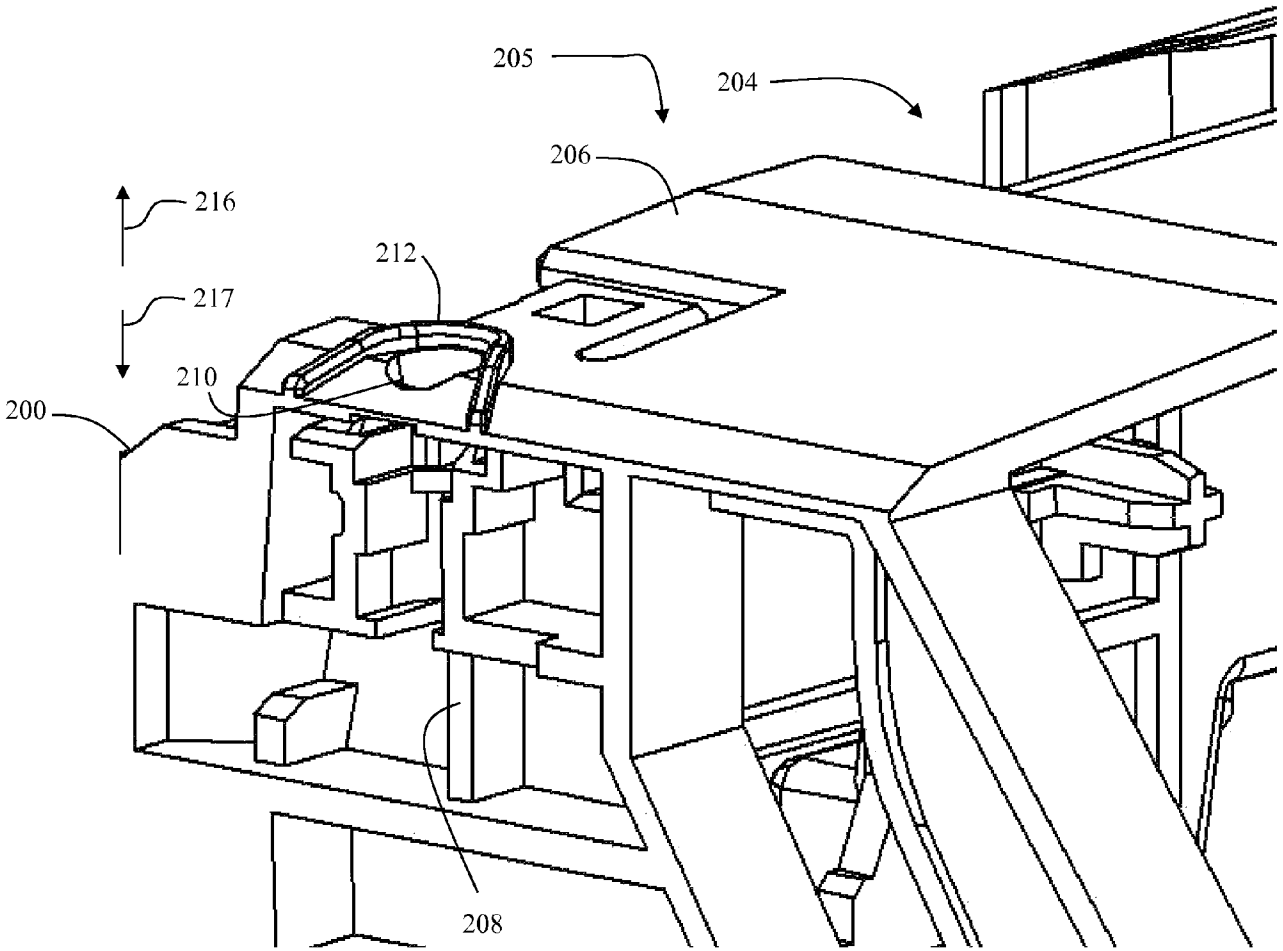
FIG. 14 is an enlarged view of a portion of FIG. 13.

A first way of improving the long-term reliability of media type detection, according to embodiments shown in FIGS. 11-14 is provided by forming a barrier 212 that projects from the bottom portion 205 of the holding receptacle 202 between the opening 204 and the viewing hole 210 for impeding the flow of ink toward viewing hole 210 and aperture slot 211. FIG. 11 is a bottom perspective of the carriage 200 including the barrier 212, and FIG. 12 is an enlarged view of a portion of FIG. 11. FIG. 13 is a side perspective of the carriage 200 including the barrier 212, and FIG. 14 is an enlarged view of a portion of FIG. 13. In the example shown in FIGS. 11-14, the barrier 212 is curved such that it has a first end 213 at first side wall 208, a second end 214 at the first side wall 208 and an intermediate portion 215 that is closer to the opening 204 than the first end 213 or the second end 214 (see FIG. 12). In other words, the barrier 212 is open at the first side wall 208. As shown in FIGS. 13 and 14, the barrier 212 projects from the bottom portion 205 of the holding receptacle 202 in a first direction 216, and first side wall 208 extends from bottom portion 205 in a second direction 217 opposite the first direction 216. The barrier 212 and the viewing hole 210 can be formed by injection molding at the same time the carriage 200 is injection molded.

Figure 15:
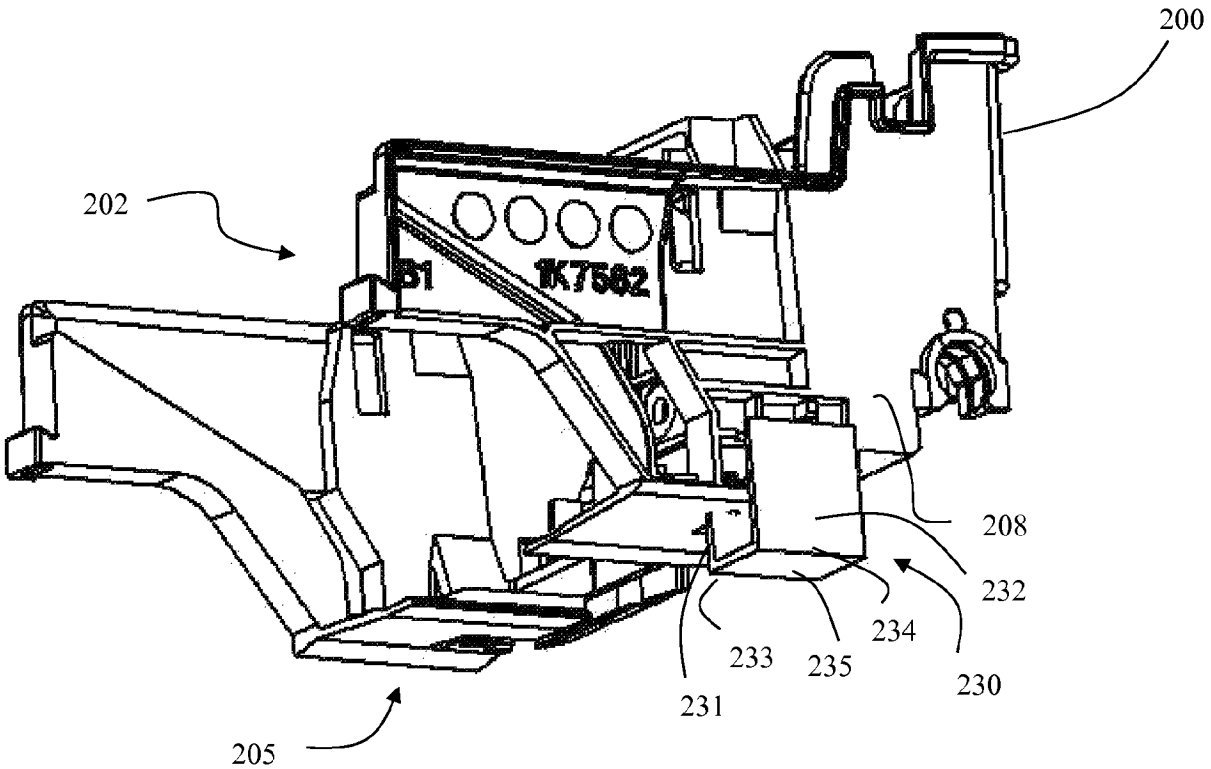
FIG. 15 is a side perspective of a wick in contact with a bottom portion of the carriage according to an embodiment of the invention.
Figure 16:
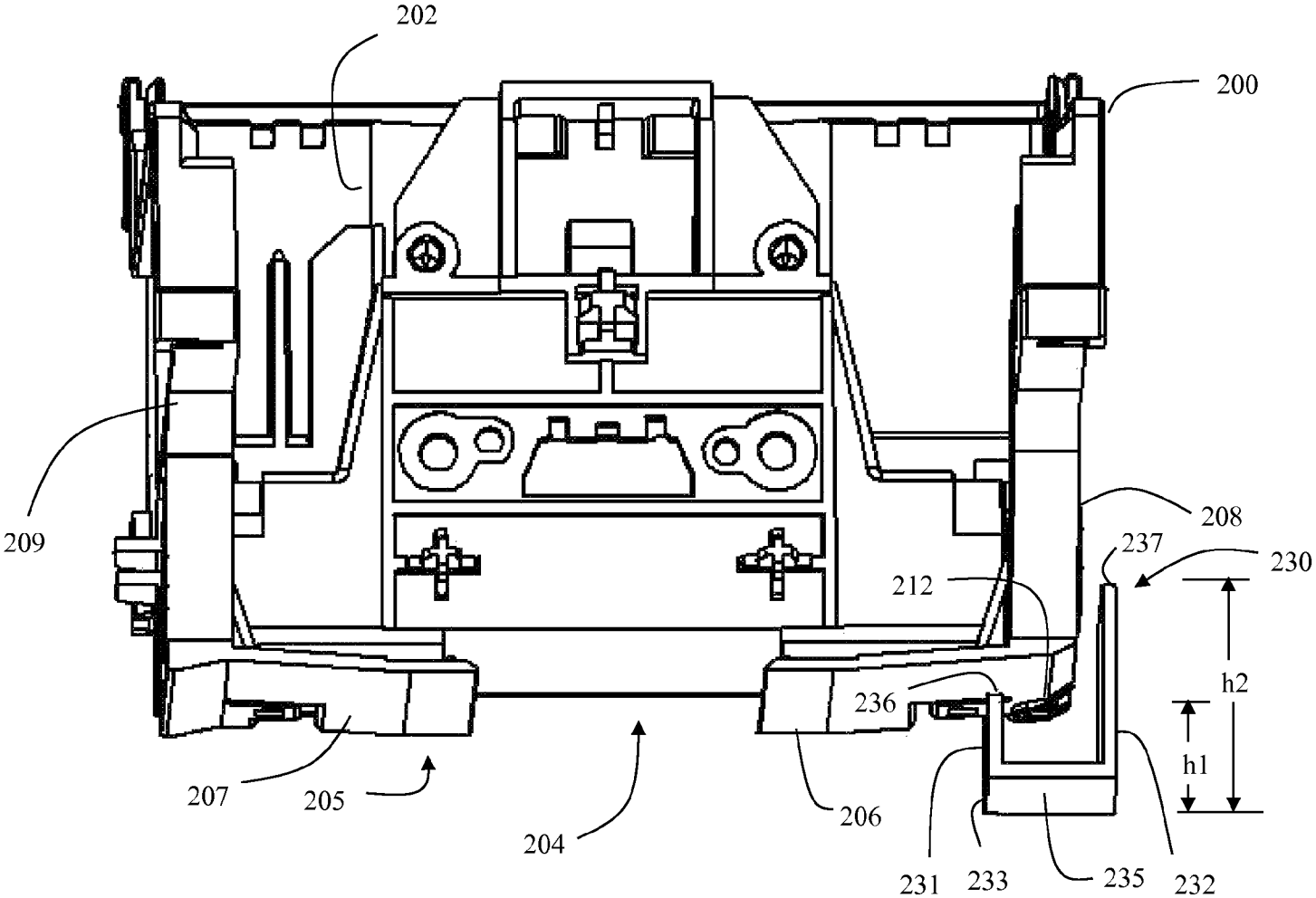
FIG. 16 is a front perspective of the wick and carriage of FIG. 15.
Figure 17:
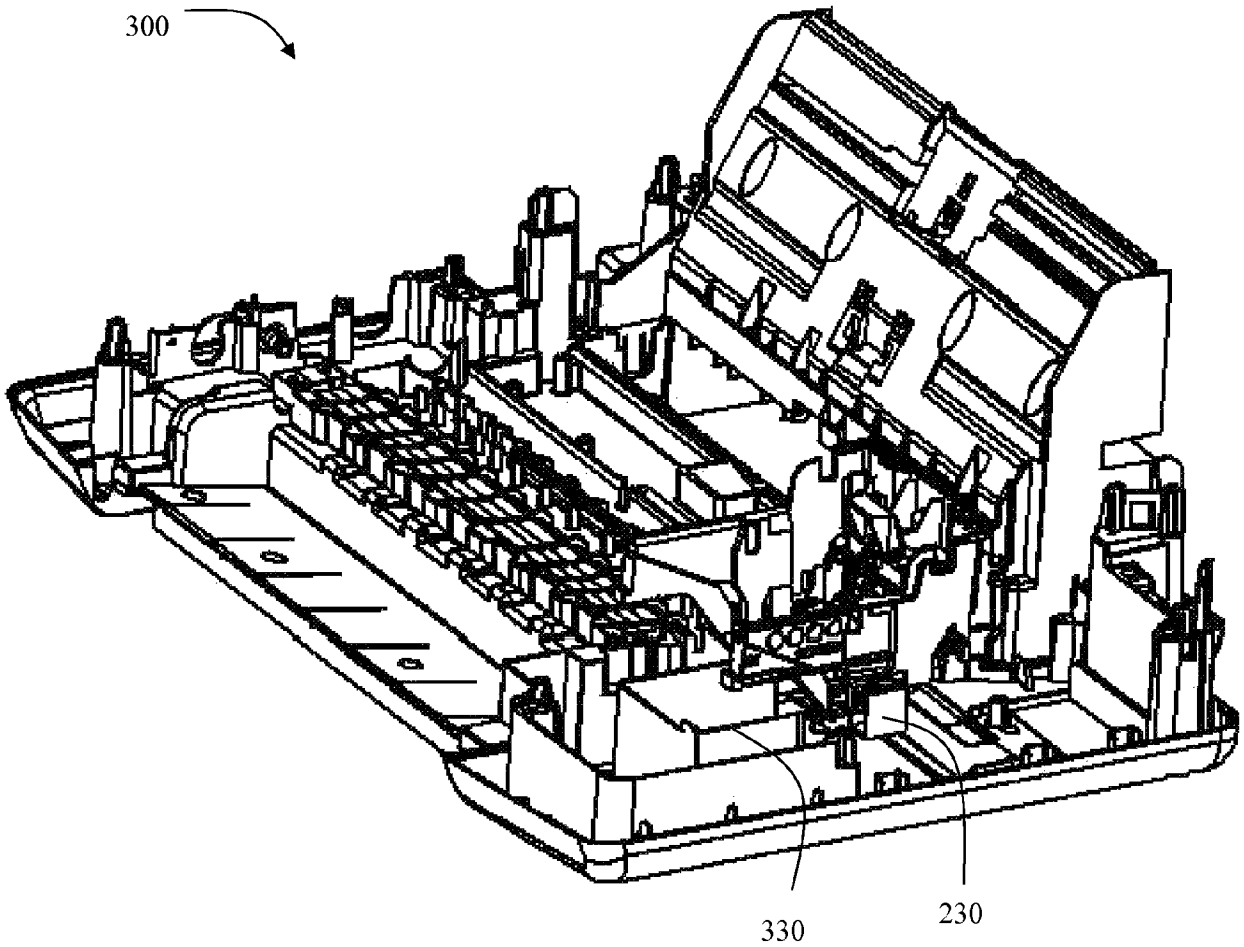
FIG. 17 is a perspective of the wick mounted near the maintenance station in a printer chassis.

A second way of improving the long-term reliability of media type detection, according to an embodiment shown in FIGS. 15-17 is provided by a wick 230 that is configured to contact the bottom portion 205 of the holding receptacle 202 near the viewing hole 210 for removing accumulated ink. FIG. 15 shows a side perspective and FIG. 16 shows a front perspective of the wick 230 in contact with the bottom portion 205 near the first side wall 208. In FIG. 17, the wick 230 is mounted near the maintenance station 330 (see also FIG. 3) in the printer chassis 300.

In the embodiment shown in FIGS. 15-17, the wick 230 is formed from a flexible sheet of capillary medium such as felt or foam. The wick 230 has a first fold 233 and a second fold 234. The first fold 233 is located between a base 235 of the wick 230 and a first leg 231 of the wick 230. The base 235 is substantially parallel to the bottom portion 205 of the holding receptacle 202 of the carriage 200. The first leg 231 has a first end 236 disposed at a first height h1 above the base 235. The bottom portion 205 of the holding receptacle 202 of the carriage 200 is located a distance above the base 235 that is less than or equal to first height h1, so that when the carriage 200 is moved to a position near the maintenance station 330, the first end 236 of the first leg 231 of the wick 230 contacts and wipes the bottom portion 205 of the holding receptacle 202 to remove accumulated ink near viewing hole 210 (FIG. 12). The position of the first leg 231 is typically such that the printhead die 251 (FIG. 8) is not contacted by the wick 230. The second fold 234 is located between the base 235 and a second leg 232. The second leg 232 has a second end 237 disposed at a second height h2 above the base 235. The second height h2 is greater than first height h1.

The second leg 232 is not intended to contact the bottom portion 205 of the carriage 200. Rather, the second leg 232 provides a large area for evaporation of volatile ink components from the ink absorbed by the wick 230.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium

21 Memory
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
201 Bushing
202 Holding receptacle
204 Opening
205 Bottom portion (of holding receptacle)
206 First flap
207 Second flap
208 First side wall
209 Second side wall
210 Viewing hole
211 Slot
212 Barrier
213 First end (of barrier)
214 Second end (of barrier)
215 Intermediate portion
216 First direction
217 Second direction
221 First type recording medium
222 Second type recording medium
225 First bar of anchor bar pair
226 Second bar of anchor bar pair
228 Identification mark for first type recording medium
229 Identification mark for second type recording medium
230 Wick
231 First leg
232 Second leg
233 First fold
234 Second fold
235 Base (of wick)
236 First end (of first leg)
237 Second end (of second leg)
240 Field of view
244 Connector
250 Printhead
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
271 Ink ports
272 Compartment
274 Compartment
300 Printer chassis
301 Paper load entry direction (for L path)
302 Horizontal base (of printer)
303 Print region
304 Media advance direction
305 Carriage scan direction
306 Right side of printer chassis
307 Left side of printer chassis
309 Rear of printer chassis
312 Feed roller
314 Gear drive
320 Media input support
321 Pick roller
323 Idler roller
324 Discharge roller
325 Star wheel(s)
330 Maintenance station
352 Pick arm assembly
370 Stack of media
371 Sheet
381 Encoder sensor
382 Carriage guide rail
400 Absorbent material
405 Support pins
410 Light source
420 Platen
425 Optical sensor
430 Ink drops

The invention claimed is:

1. An inkjet printer comprising:
an inkjet printhead including a printhead die having an array of nozzles;
a media advance system for moving recording medium along a media path toward a print region;
a carriage for moving the inkjet printhead back and forth across the print region, wherein the carriage includes:
a holding receptacle for the inkjet printhead, the holding receptacle including a bottom portion having an opening into which the printhead die extends;
an optical sensor; and
a viewing hole in the bottom portion of the holding receptacle, the viewing hole providing an optical pathway between the optical sensor and a portion of the media path; and
a wick configured to contact the bottom portion of the holding receptacle distal to the printhead die which extends into the opening so that the wick does not contact the printhead and proximate the viewing hole for removing accumulated ink.

2. The inkjet printer of claim 1, wherein the wick includes at least one fold.

3. The inkjet printer of claim 2, wherein the wick includes:
a base disposed substantially parallel to the bottom portion of the holding receptacle of the carriage; and
a first leg having a first end disposed at a first height above the base, wherein the bottom portion of the holding receptacle of the carriage is located a distance above the base that is less than or equal to the first height.

4. The inkjet printer of claim 3, wherein the wick further includes a second leg having a second end disposed at a second height above the base.

5. The inkjet printer of claim 4, wherein the second height of the second end of the second leg is greater than the first height of the first end of the first leg of the wick.

6. Then inkjet printer of claim 1 further comprising a maintenance station, wherein the wick is disposed proximate the maintenance station.

7. The inkjet printer of claim 1 further comprising a light source disposed on a first side of the portion of the media path, wherein the carriage is disposed on a second side of the portion of the media path opposite the first side.

8. The inkjet printer of claim 1 further comprising a controller for analyzing signals from the optical sensor for identifying a type of recording medium.

9. The inkjet printer of claim 1, the carriage further including a first side wall extending from the bottom portion of the holding receptacle, wherein the optical sensor is disposed proximate the first side wall.

10. The inkjet printer of claim 9, the carriage further including a second side wall extending from the bottom portion of the holding receptacle opposite the first side wall.

11. The inkjet printer of claim 10, wherein the bottom portion of the holding receptacle includes:

a first flap extending between the first side wall and the opening; and a second flap extending between the second side wall and the opening.

12. The inkjet printer of claim 11, wherein the viewing hole is disposed in the first flap.

13. The inkjet printer according to claim 1, wherein the viewing hole includes a slot.

* * * * *